United States Patent [19]

Rabey et al.

[11] Patent Number: 4,757,163

[45] Date of Patent: Jul. 12, 1988

[54] SWITCHED PATCH MODULE

[75] Inventors: Alexander Rabey, Hatboro; Herbert J. Hampel, Feasterville, both of Pa.

[73] Assignee: VIR, Inc., Southampton, Pa.

[21] Appl. No.: 934,901

[22] Filed: Nov. 25, 1986

[51] Int. Cl.[4] ..... H01R 19/00

[52] U.S. Cl. ..... 200/51.03; 200/51.09; 200/51.1

[58] Field of Search ..... 200/51 R, 51.03, 51.04–51.06, 200/51.09, 51.1, 153 LA, 50 A; 222/132; 379/332, 329; 439/188

[56] References Cited

U.S. PATENT DOCUMENTS

| | | | |
|---|---|---|---|
| 3,588,399 | 6/1971 | Viosca | 200/51.1 |
| 3,609,462 | 9/1971 | De Barros | 339/176 |
| 4,034,170 | 7/1977 | Raabe | 200/50 A |
| 4,037,186 | 7/1977 | Palmer | 200/51.09 |
| 4,047,782 | 9/1977 | Yeager . | |
| 4,053,724 | 10/1977 | Llona | 200/51.09 |
| 4,112,401 | 9/1978 | Palmer | 335/206 |
| 4,118,094 | 10/1978 | Key . | |
| 4,140,918 | 2/1979 | Lancaster | 200/51.07 |
| 4,154,994 | 5/1979 | Seiden | 200/51.09 |
| 4,203,066 | 5/1980 | Buck | 324/133 |
| 4,237,352 | 12/1980 | Seiden | 200/51.03 |
| 4,238,655 | 12/1980 | Vonder . | |
| 4,256,936 | 3/1981 | Lancaster | 200/51.07 |
| 4,363,941 | 12/1982 | Nelson . | |
| 4,460,811 | 7/1984 | Murr | 200/51.03 |
| 4,476,357 | 10/1984 | Malmborg | 200/51.09 |
| 4,504,101 | 3/1985 | Reimer . | |

*Primary Examiner*—Henry J. Recla
*Assistant Examiner*—Linda J. Sholl
*Attorney, Agent, or Firm*—William H. Eilberg

[57] ABSTRACT

The invention is a switched patch module which provides convenient access to a plurality of communications or data lines, without undesirable mixing of signals. The patch module is formed on a printed circuit board which completes connections between the conductors of two sets of receptacles, such that these receptacles are hard-wired together. The user can connect either the first or second receptacle to a third receptacle, by selecting the position of a manually-operated two-position switch. However, insertion of a plug into the receptacle selected by the manually-operated switch disconnects the third receptacle from the other receptacles, while insertion of a plug into the non-selected receptacle has no such effect. Also, insertion of a plug into the third receptacle dissconnects the third receptacle from the others, and overrides the effect of the manually-operated switch. When the plugs are removed, the connections selected by the manually-operated switch are restored. The switching is performed by a sliding panel, mounted to move along the board. The panel has contacts which make and break electrical connections on the board. The setting of the manually-operated switch determines the initial position of the panel, the panel being moved into this position by a motor and gear arrangement. Insertion of a plug pushes a tab, which makes the panel move in the desired direction, by cam action.

21 Claims, 3 Drawing Sheets

SWITCHED PATCH MODULE

BACKGROUND OF THE INVENTION

This invention relates to the field of switching devices. The invention is especially useful in the computer and telecommunications fields, although the invention is not limited to any particular area of use.

In a computer installation, it is often necessary to connect one, but only one, of a plurality of computers to a modem, or other hardware device. It is also often necessary to provide a patching connection, whereby an external piece of equipment, such as a substitute or back-up computer, can be connected to one of the main computers.

In the prior art, the above-described objectives have required two independent switching devices. First, one needs a switch which alternately connects one of the computers to the modem line. Secondly, one needs a switch which will automatically break the connection between the computer being serviced and the modem. The devices of the prior art have generally employed two independent switching means for these purposes, and are relatively complicated.

One example of a switching module of the prior art is shown in U.S. Pat. No. 4,112,401. This patent shows a sliding panel on a printed circuit board, the panel being designed to actuate an array of magnetic switches, and thereby to connect and disconnect a plurality of computers from other devices.

Another problem encountered with many switching devices is that one can patch a connection to only one computer at a time. It is often impossible to patch a connection to the equipment which is not being serviced. This inflexibility severely hampers the operation of systems employing a plurality of computers.

Some of the prior art devices have addressed this problem of providing "off-line" access, so as to allow use of the lines which are not currently connected to a computer, for other purposes. An example of a patch module, of the prior art, for providing off-line access, is shown in U.S. Pat. No. 4,237,352. A patching device which makes alternative connections between pieces of equipment, depending on whether and where a plug is inserted, is shown in U.S. Pat. No. 3,588,399. One object of the invention is to provide an improved structure which provides such off-line access.

The present invention provides a module which permits separate patching connections for several computers, wherein all of which connections remain operative whether the computers are "on-line" or "off-line". The invention uses essentially one switching means, which is preferably a slidable panel on a printed circuit board. The initial position of this switching means is controlled by a separate switch, which may be mounted near the panel, or placed in a remote location. The invention maximizes the flexibility of a patch module, because it allows a plurality of diagnostic instruments to be connected to a set of computers, without disrupting the operations of the computers not being serviced.

SUMMARY OF THE INVENTION

The switched patch module of the present invention is preferably mounted on a printed circuit board having two sets of receptacles. There are at least three receptacles in both sets. The receptacles of the first set are conveniently designated as A, B, and C, and the receptacles of the second set are called 1, 2, and 3. The conductors of receptacles A and 1 are "hard-wired" together by the connections formed on the printed circuit board. Similarly, receptacle B is hard-wired to receptacle 2, and receptacle C is hard-wired to receptacle 3.

A two-position, manually-operated switch selects either of receptacles A and B to be connected to receptacle 3. However, the setting of the manually-operated switch can be overridden when a plug is inserted into one of the receptacles, as described below.

In the preferred embodiment, the connecting and disconnecting of the various receptacles is performed by a panel which slides along the board, making and breaking electrical contact. The panel has three positions, called the "A", "B", and neutral positions. In the A position, receptacle A is connected to receptacle 3. In the B position, receptacle B is connected to receptacle 3. In the neutral position, there is no connection between either of receptacles A or B, and receptacle 3.

The panel can be moved to the A or B position by a motor which is actuated by the manually-operated switch. The panel is also moved when a plug is inserted into certain receptacles, depending on the initial position of the panel. Each of receptacles A, B, and C has a tab, which is pushed by the incoming plug. Each tab has a beveled surface, which pushes against a similarly oriented beveled surface on the slidable panel. The result is that the panel slides along the board, in a direction perpendicular to the direction of movement of the plug, making or breaking connections as it moves.

The cam surfaces of the tabs and the panel are arranged such that the panel moves only under certain conditions. In particular, when the switch is in the A position, so that receptacle A is connected to receptacle 3, insertion of a plug into receptacle A moves the panel to the neutral position. Thus, the plug in receptacle A connects with receptacle 1, but all connections with receptacle 3 are simultaneously broken. when a plug is already in receptacle A, insertion of a plug into receptacle B has no further effect on the panel, but it does permit connection of equipment to receptacle 2. Also, when the switch is in the A position, and a plug is inserted only into receptacle B, the panel does not move, and the plug is connected to receptacle 2 only.

When the switch is in the B position, the converse occurs. Insertion of a plug into receptacle B moves the panel to the neutral position, while insertion of a plug into receptacle A has no effect on the panel, whether or not there is a plug in receptacle B.

When a plug is inserted into receptacle C, the panel is moved to the neutral position, from the A or B position. While the plug is in receptacle C, insertion of plugs into A or B have no effect on the panel.

The present invention therefore allows maximum access to a set of computers or other devices. For example, disconnection of receptacle A from receptacle 3 does not impair the connection between receptacles B and 2. External devices can therefore be patched to a set of computers, while automatically disconnecting those computers from a modem, without the need for additional switching. Also, the modem line can be monitored without the need separately to disconnect the previously connected computers from the modem. All of the above operations are performed by one switching means, namely a sliding panel on a printed circuit board, with a minimum of effort.

It is therefore an object of the invention to provide a switched patch module for connecting electronic equipment to a plurality of devices.

It is another object to provide a switched patch module, wherein the use of one patching plug does not affect the other patching plugs connected to the module.

It is another object to provide a switched patch module, wherein the connection between one of several computers, and a modem, is automatically disconnected when a patching plug is connected to that computer.

It is another object of the invention to reduce the number of switches needed to connect several patching devices to a plurality of computers or peripherals.

It is another object of the invention to provide a switched patch module as described above, wherein the insertion of a patching plug is made easy by the mechanical advantage of a cam device.

It is another object of the invention to facilitate the installation, servicing, and maintenance of electronic equipment.

Other objects and advantages of the invention will be apparent to those skilled in the art, from a reading of the following brief description of the drawings, the detailed description of the invention, and the appended claims.

DETAILED DESCRIPTION OF THE INVENTION

The electrical connections made by the switched patch module of the present invention can best be explained with reference to the schematic diagram of FIG. 4. Throughout the specification and claims, the term "first set of receptacles" refers to the receptacles illustrated at the left in FIG. 4, and designated as A, B, C, and "monitor". The term "second set of receptacles" refers to the three receptacles at the right in FIG. 4, and which are designated as 1, 2, and 3.

Figure 4:
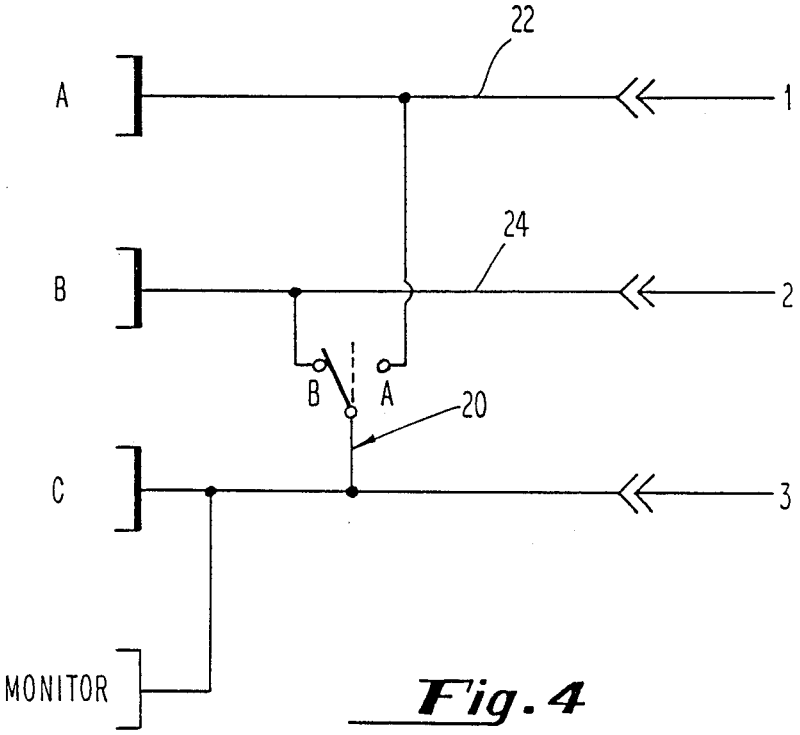
FIG. 4 is a schematic diagram of the patch module of the present invention, showing the electrical connections made and broken by the sliding panel.

In FIG. 4, only a single line is used to indicate connections between receptacles, but it is understood that each line may, in general, represent a plurality of separate conductors. Also, when the specification states that, say, receptacle A is connected to receptacle 1, it is understood that this expression means that each conductor of one receptacle is connected to the corresponding conductor of the other receptacle. In computer technology, it is common to use connectors having 25 conductors. The lines in FIG. 4 can represent any number of such conductors.

The connections indicated in FIG. 4 are preferably defined on a printed circuit board. The board is hardwired such that receptacle A is permanently connected to receptacle 1, by line 22. Similarly, receptacle B is permanently connected to receptacle 2, by line 24, and receptacle C is permanently connected to receptacle 3, by line 26. A "monitor" receptacle is shown permanently connected to receptacles C and 3.

Switch 20 in FIG. 4 has three positions, an "A" position, a "B" position, and a neutral position. The neutral position is indicated by the dotted line. In practice, switch 20 is controlled by a separate, manually-operated switch having two positions selectable by the user. The third position, i.e. the neutral position, is not selectable by the manually-operated switch, but is instead selected by appropriate insertion of patching plugs into the receptacles, as will be explained below. The insertion of these plugs, under certain conditions, overrides the effect of the manually-operated switch, and places switch 20 in the neutral position.

Thus, in FIG. 4, switch 20 is intended to represent schematically both the two-way manually-operated switch and a separate three-way switching element. The latter element is preferably a sliding panel, and this element will be described in detail later.

When switch 20 is in the "A" position, and no patching plugs have overridden this setting, receptacle A is connected to receptacle 3 (and thus to receptacle C, also). In the "B" position, which is shown in FIG. 4, receptacle B is connected to receptacle 3. When the switch is in the A position, receptacle B is isolated from receptacle 3. Conversely, when switch 20 is in the B position, receptacle A is isolated from receptacle 3. In the neutral position, neither receptacle A nor B is connected to receptacle 3.

Receptacles A, B, and C are illustrated schematically with heavy shading in FIG. 4, to symbolize that when a plug is inserted into these receptacles, a connection is broken. In particular, if the switch is in the A position, insertion of a plug into receptacle A will move the switch to the neutral position. But insertion of a plug into receptacle B, while the switch is in the A position, has no effect on the switch, whether or not there is a plug in receptacle A.

If the switch is in the B position, insertion of a plug into receptacle B moves the switch to the neutral position. Insertion of a plug into receptacle A, while the switch is in the B position, has no effect on the switch, regardless of whether there is a plug in receptacle B.

If the switch is in the A or B position, insertion of a plug into receptacle C moves switch 20 to the neutral position.

While the invention is described with respect to a particular number of receptacles, it is understood that this embodiment is merely exemplary, and not limiting. There could be more than three receptacles in the first and second sets. There could also be additional monitoring receptacles, within the scope of the invention.

The means by which connections are made and broken, in the switched patch module of the present invention, is generally similar to that which is described in our copending U.S. Patent Application, Ser. No. 901,053, filed Aug. 26, 1986, entitled "Patch Module", now U.S. Pat. No. 4,705,921.

Figure 1A:
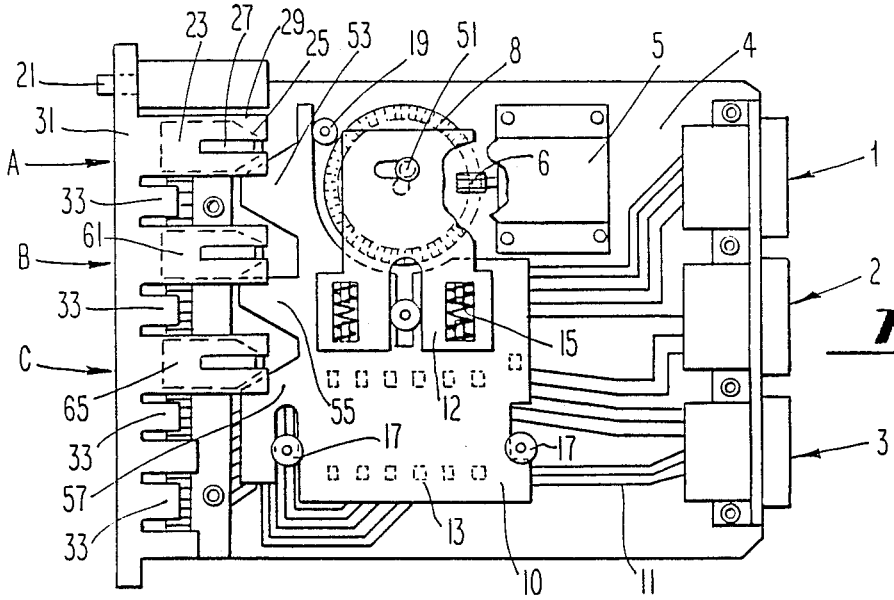
FIG. 1A is a plan view, partly broken away, of the switched patch module, showing the panel in the "A" position, with no plugs in the receptacles.

FIGS. 1 and 2 show plan views of the switched patch module of the present invention. FIG. 1A is partly broken away so that a motor and gear arrangement, for moving a sliding panel, is more clearly shown. The other figures, of FIGS. 1 and 2, are fragmentary plan views; for the sake of simplicity, the receptacles 1, 2, and 3 are not repeated in these views. Receptacles A, B, and C, and also 1, 2, and 3 are the same as the similarly designated receptacles of FIG. 4.

The patch module is mounted on printed circuit board 4. Some of the wiring on the board 4 is indicated by reference numeral 11, but no attempt has been made, in these figures, to illustrate all of the connections on the board. Instead, the electrical connections are shown schematically in FIG. 4.

Figure 1B:
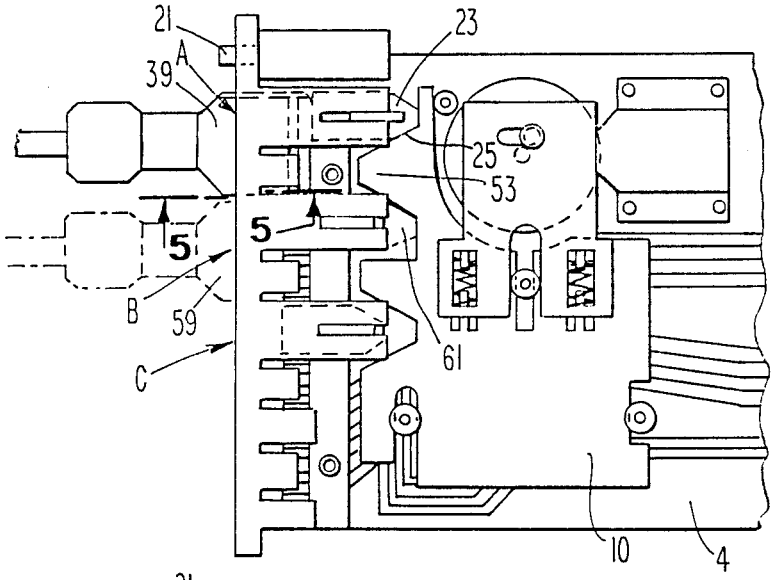
FIG. 1B is a fragmentary plan view, similar to FIG. 1A, showing the panel in the "A" position, with a plug in receptacle A, and a plug, shown in phantom, in receptacle B.

A slidable panel 10 is mounted on board 4. Panel 10 is held in place on the board by rollers 17 and 19. Note that these rollers are positioned to allow panel 10 to slide only in a direction generally perpendicular to the direction of insertion of plug 39, as shown in FIG. 1B.

Panel 10 is moved by the action of eccentric pin 51 mounted on toothed wheel 8. The toothed wheel is rotated by gear 6 which is driven by motor 5. The motor is actuated by switch 21. This switch is the two-way manually-operated switch discussed above, and it is also called the "A/B" switch, because it selects the A or B position, described above with respect to FIG. 4. Although switch 21 is shown mounted on printed circuit board 4, it can also be placed in a remote location.

Movement of gear 6 causes panel 10 to slide upward or downward along board 4, as shown in the drawings. Panel 10 may include an auxiliary panel 12, which is pushed directly by eccentric pin 51, and which transmits its motion to the main panel 10 by springs 15. The springs insure that the panel returns to its previous position when plugs are removed.

FIG. 1A also shows, in dotted outline, some of the switch contacts 13 of the panel. These contacts are hidden in the view of FIG. 1A; one such contact will be described later in more detail, with reference to FIG. 3. The contacts make and break circuits on the circuit board 4. The precise shape of the contacts is not critical to this invention.

Molding 31 defines a plurality of receptacles for the insertion of plugs, there being four such receptacles shown in FIG. 1. The first three are receptacles A, B, and C. The fourth receptacle is the monitor receptacle, also shown schematically in FIG. 4. Latches 33 are attached to the molding, and are designed to engage a groove in the plug being inserted into the receptacle.

Figure 5:
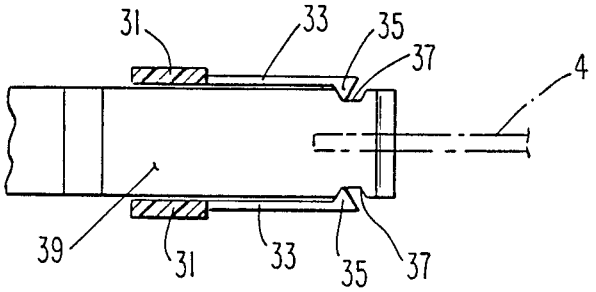
FIG. 5 is a cross-sectional view of a latching mechanism for the patching plug, taken along the line 5—5 of FIG. 1B.

The latches are more clearly shown in the cross-sectional view of FIG. 5, taken along the line 5—5 of FIG. 1B, in which plug 39 is shown in engagement with printed circuit board 4. Latches 33 have projections 35 which engage groove 37 in plug 39. The latches, like molding 31, are preferably formed of plastic, and are sufficiently resilient that they can bend when the plug is inserted and removed.

Mounted within the sockets for receptacles A, B, and C are tabs 23, 61, and 65. The tabs are all of identical construction, and have guides, such as guide 27 of tab 23. The guides slide within housings, such as housing 29. The housings define slots through which the guides can slide.

Each tab includes a beveled surface, such as the surface indicated by reference numeral 25, in tab 23. The beveled surfaces are angled to correspond with similar beveled surfaces on projections 53, 55, and 57, of panel 10.

When plug 39 is inserted into receptacle A, as shown in FIG. 1B, the plug pushes tab 23 to the right. Guide 27 slides through the slot defined by housing 29, and the beveled surface 25 of tab 23 abuts the similarly angled surface of projection 53 of panel 10. The pressure exerted on panel 10, from plug 39, causes the panel to slide downward, as viewed in FIG. 1B. That is, panel 10 moves in a direction generally perpendicular to that of the incoming plug. That is the only direction in which the panel is free to move.

As the plug is inserted, its contacts slide over similar contacts on the printed circuit board. The cam action of the tabs is such that the distance traveled by the plug, from the point at which it first touches the tab to its final inserted position, is greater than the distance traveled by the panel. Therefore, the module creates a mechanical advantage whereby the plug can very easily overcome the spring force of the panel. In other words, the panel can be moved a short distance by exerting a relatively small force, on the plug, over a longer distance. When the plug is fully inserted, latches 33 engage the grooves in the plug, and prevent the plug from becoming dislodged by the spring-biased panel.

When panel 10 moves downward, as viewed in FIG. 1B, it breaks the connection between receptacles A and 3. The means by which the connection is broken are not visible in FIGS. 1 or 2. Any conventional means for breaking the connection can be employed. One example of such circuit-breaking means is shown in FIG. 3.

Figure 3:
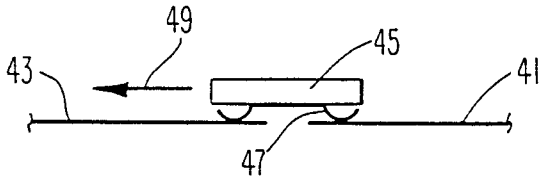
FIG. 3 is an end view showing one of the contacts of the panel of the switched patch module, as it completes a connection on the printed circuit board.

In FIG. 3, reference numerals 41 and 43 designate a pair of conductors in a printed circuit board, the conductors being aligned to define a gap. When this gap is closed, the conductors are electrically connected. FIG. 3 shows metallic contact 47, mounted on carrier 45. The carrier is preferably made of an insulating material. It is understood that there would be many similar carrier and contact assembilies, for the other conductors associated with a given receptacle. All of these would be mounted on the printed circuit board, and the carriers would be affixed to the slidable panel (not shown in FIG. 3). When carrier 45 is in the position shown in FIG. 3, contact 47 completes the connection between conductors 41 and 43. When carrier 45 has been moved sufficiently in the direction indicated by arrow 49, the connection between conductors 41 and 43 is broken.

It is understood that there may be separate carrier and contact assemblies for each of the conductors connecting receptacles A and 1, and B and 2, and so on. It is also understood that the carriers are affixed to the slidable panel (not shown in FIG. 3).

The means for making and breaking the connections between the conductors of the various receptacles can take other forms. The specific structure for making and breaking the connections is not critical to this invention. What is important is that the sliding panel which makes and breaks the connections be slidable in a direction generally perpendicular to that of the incoming plug.

The structure described so far enjoys the same advantages as the patch module disclosed in our above-cited patent application. It permits patching plugs to be inserted into the patch module with very little force, due to the mechanical advantage described. The plugs are not inserted directly against the force of a spring, but instead push the panel in a direction generally perpendicular to that of the motion of the plug, through cam action. Therefore, the size and strength of the spring can be reduced, by contrast with the springs used in the prior art. The simple latch structure shown above suffices to hold the plug securely against the force of the panel. The plug can be dislodged only by pulling it out. The patch module of the present invention is therefore easy to use, more reliable, and less expensive to build than the devices previously known.

The switching of the patch module of the present invention is accomplished by cam action created by the movement of the tabs towards projections 53, 55, and 57, on panel 10. The projections form the cam surfaces. Insertion of a plug into the various receptacles pushes the tab associated with that receptacle, and the beveled surface of the tab may engage the adjacent cam surface of the panel, depending on the previous position of the panel. The panel may thus be moved upward or downward, causing connections to be broken. The operation of the device will be described with reference to all of the drawings of FIGS. 1 and 2.

Figure 1C:
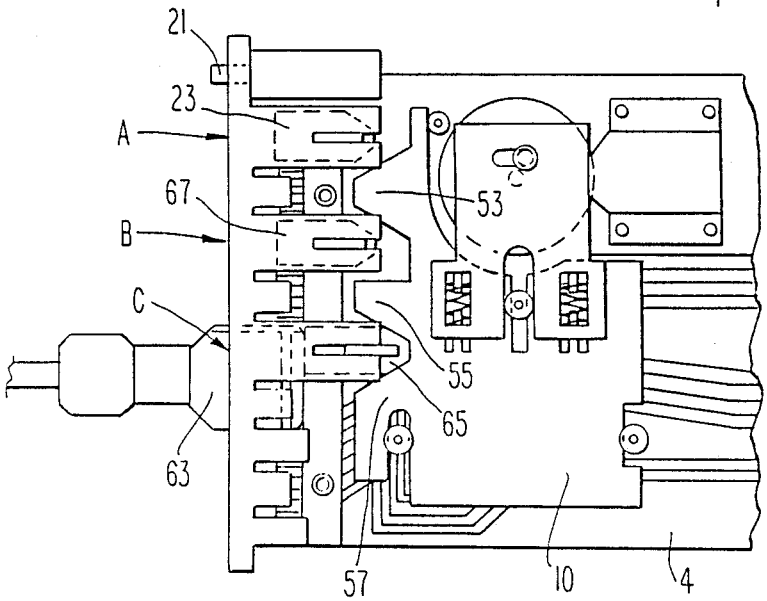
FIG. 1C is a fragmentary plan view, similar to FIG. 1A, showing the panel in the "A" position, with a plug in receptacle C.

FIGS. 1A, 1B, and 1C all show the switched patch module with the switch 21 in the A position. As stated above, the setting of switch 21 can be overridden by the insertion of a plug, as will be described below.

FIG. 1A shows the switched patch module without any plugs in receptacles A, B, and C. Since switch 21 is in the A position, the panel is positioned to connect receptacle A to receptacle 3. Of course, when a connection is made with receptacle 3, a connection is also automatically made with receptacle C.

FIG. 1B shows the switched patch module with plug 39 inserted into receptacle A. The plug pushes tab 23 to the right, such that beveled surface 25 of the tab pushes against the adjacent surface on projection 53 of panel 10. As the tab is pushed to the right, the panel is pushed downward. This motion causes the contacts connected to the underside of the panel (not visible in FIG. 1B) to slide, and to break the connection between receptacle A and receptacle 3. Thus, insertion of plug 39 into receptacle A moves the panel to the neutral position. However, receptacle A is still hard-wired to receptacle 1, and receptacle B is still hard-wired to receptacle 2. These connections are unaffected by the position of the panel.

While plug 39 is inserted into receptacle A, insertion of a plug into receptacle B has no effect on the panel. Plug 59 is shown, in phantom, inserted into receptacle B. Its tab 61 is pushed to the right, but due to the shape of the cam surface of projection 53, the movement of the tab does not push the panel. Instead, the tab comes to rest in near perfect abutment with the projection of the panel. Thus, a patching plug can be inserted into receptacle B, to connect a device to receptacle 2, even while a plug is in receptacle A, and while the connection between receptacles A and 3 is broken.

Also, it is apparent, from inspection of FIG. 1A, that insertion of a plug into receptacle B, when the switch is in the A position, will have no effect on the panel. This is true because tab 61 of receptacle B is not pressed against any surface defined by the panel. Instead, tab 61 would move into close abutment with the surfaces of projections 53 and 55.

FIG. 1C shows plug 63 inserted into receptacle C, while switch 21 is still in the A position. The motion of the panel can be visualized by comparing FIG. 1A with FIG. 1C. Due to the shape of projection 57 of panel 10, insertion of plug 63 into receptacle C causes the panel to move downward, by the same distance that it moved when a plug was inserted into receptacle A. This movement again breaks the connection between receptacles A and 3. The panel is therefore moved to the neutral position. If plugs are now inserted into either of receptacles A or B, or both, the panel will not move further. This fact is apparent from inspection of FIG. 1C, which shows the position of projections 53 and 55 relative to tabs 23 and 67 of receptacles A and B, respectively. As before, a patching plug inserted into receptacles A and/or B will still be effective in connecting equipment to receptacles 1 or 2.

It is noted that despite the position of the panel, switch 21 remains in the A position in all of FIGS. 1A, 1B, and 1C. The position of the switch determines which of receptacles A and B will be connected to receptacle 3 when no plug has been inserted to override that setting. Thus, if switch 21 is in the A position, it remains in that position. Insertion of a plug into receptacles A or C will move the panel into the neutral position, overriding the setting of the switch. But when those plugs are removed, the action of springs 15 causes the panel to slid back to the position selected by switch 21, and the connection to receptacle 3 is restored.

Figure 2A:
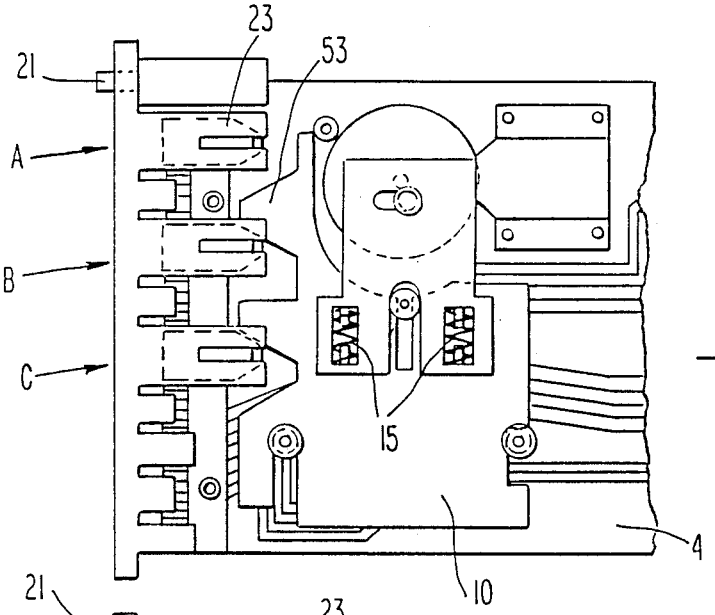
FIG. 2A is a fragmentary plan view, of the switched patch module, showing the panel in the "B" position, with no plugs in the receptacles.
Figure 2B:
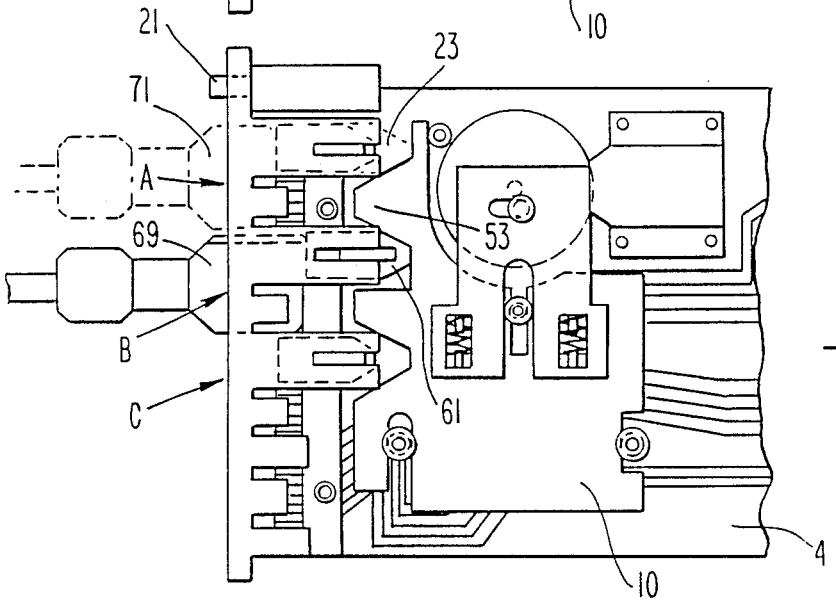
FIG. 2B is a fragmentary plan view similar to FIG. 2A, showing the panel in the "B" position, with a plug in receptacle B, and a plug, shown in phantom, in receptacle A.
Figure 2C:
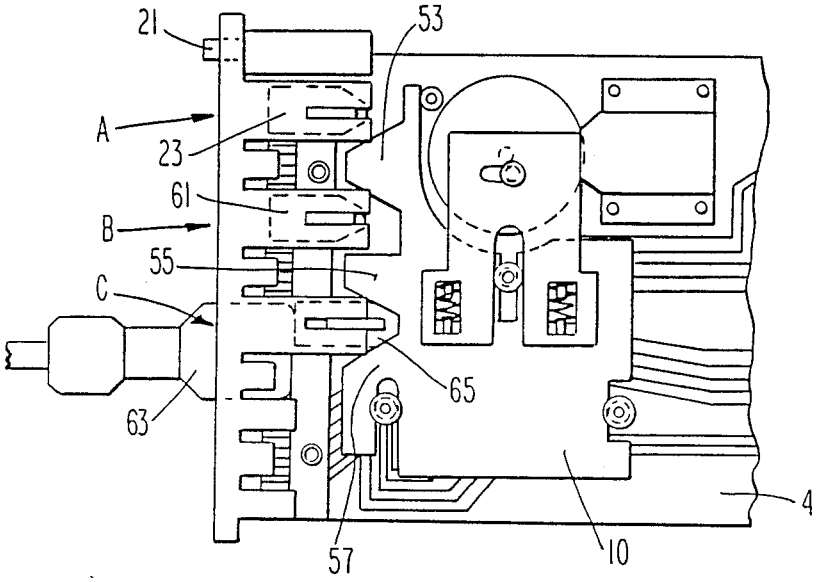
FIG. 2C is a fragmentary plan view similar to FIG. 2A, showing the panel in the "B" position, with a plug in receptacle C.

FIGS. 2A, 2B, and 2C are similar to FIGS. 1A, 1B, and 1C, except that it is assumed that switch 21 is now in the B position. In FIG. 2A, no plugs are inserted into the receptacles. In the B position, the panel has been moved somewhat lower on the board, as compared with the A position of FIG. 1A. The panel has been moved into this position by the action of motor 5, as discussed above. In FIG. 2A, the connections are such that receptacle B, and not receptacle A, is connected to receptacle 3.

In FIG. 2B, plug 69 has been inserted into receptacle B. Insertion of plug 69 pushes tab 61 to the right, so that the beveled surface of the tab pushes against the similar surface of projection 53 of panel 10. The shape of projection 53 is such that panel 10 moves upward slightly, under the influence of the tab, causing the connection between receptacles B and 3 to be broken. Now, if plug 71 is inserted into receptacle A, there is no effect on the panel. As shown in FIG. 1B, tab 23 is pushed to the right, but due to the position of the panel, tab 23 simply comes to rest in abutment with projection 53 of panel 10, without moving the panel. Receptacle A is still connected to receptacle 1, so equipment can be patched without interruption.

Note also that, in FIG. 2A, with the switch in the B position, insertion of a plug into receptacle A will have no effect on the panel. When tab 23 slides to the right, it does not engage the cam surface defined by projection 53 of panel 10.

In FIG. 2C, plug 63 is the only plug attached to the device, and it is inserted into receptacle C. As is apparent from a comparison of FIGS. 2A and 2C, and from inspection of the configuration of projections 55 and 57, insertion of plug 63 into receptacle C causes the panel to slide upward, breaking the connection between receptacles B and 3. Note that, in FIG. 2C, insertion of plug 63 into receptacle C causes the panel to move upward, while in FIG. 1C, insertion of plug 63 causes the panel to move downward. This effect is due to the initial setting of the panel in either the A or B position, and due to the configuration of cam surfaces on the projections. In both FIGS. 1C and 2C, the panel has been moved to its neutral position, overriding the setting of switch 21. When the overriding plug is removed, the action of the springs causes the panel to return to the position selected by switch 21, and the broken connections are restored.

Thus, the switching of the present invention is accomplished by a single panel, having a plurality of cam surfaces. Movement of this panel makes and breaks the desired connections, allowing convenient off-line access to certain equipment, while other items are being serviced. The user need be concerned with only one switch, namely switch 21, which sets the initial position of the panel. Since switch 21 is distinct from the sliding panel, which is the actual switching element, the patch module can be remotely controlled, by placing switch 21 in another location.

While the invention has been described with respect to the preferred embodiment shown above, it is understood that the invention can be modified in various ways. The number of receptacles can be increased, if the panel is lengthened and if it is provided with additional projections and cam surfaces. The specific means for moving the panel can also be changed. It is also possible to use a structure entirely different from the sliding panel shown in the drawings. The single moving switch element which makes and breaks the necessary connections could be replaced by two or more switches which perform equivalent functions. These and other modifications are to be deemed within the spirit and scope of the following claims.

What is claimed is:

1. A switched patch module, the module comprising first and second sets of receptacles, the first set having at least three receptacles and the second set having at least three receptacles, both of said sets of receptacles being mounted on a printed circuit board, the printed circuit board having electrical connections which join the conductors of the first receptacle of said first set with the conductors of the first receptacle of said second set, and which join the conductors of the second receptacle of said first set with the conductors of the second receptacle of said second set, and which join the conductors of the third receptacle of said first set with the conductors of the third receptacle of said second set, the module including a single panel which is slidable along the printed circuit board, the panel having contact means for completing connections, on the printed circuit board, the panel having a first position, wherein the conductors of the first receptacles of the first and second sets are connected to the conductors of the third receptacles of the first and second sets, the panel having a second position, wherein the conductors of the second receptacles of the first and second sets are connected to the conductors of the third receptacles of the first and second sets, the panel also having a neutral third position, wherein the conductors of the first and second receptacles of the first and second sets are disconnected from the conductors of the third receptacles of the first and second sets, the panel being movable into its first and second positions by a motor, in response to the setting of a two-position switch, wherein the patch module also comprises a tab, slidably mounted within both the first, second, and third receptacles of said first set, the tab being slidable towards the panel in response to pressure from a plug inserted into the receptacle, wherein the panel is movable in a direction generally perpendicular to that of the tab, and wherein the panel includes a cam surface which abuts the tab, wherein movement of the tab, towards the panel, causes the panel to move in a direction generally perpendicular to that of the tab, the cam surface being such that the distance traveled by the panel is less than the distance traveled by the plug, and wherein insertion of a plug into that receptacle of said first set which has been selected by the two-position switch causes the panel to slide along the board so as to move to its neutral position, wherein the connection between the selected receptacle and the third receptacle of said second set is broken, and wherein insertion of a plug into the third receptacle of the first set causes the panel to move to the neutral position, and wherein the panel is spring biased such that the panel offers resistance to the insertion of a plug into any of the receptacles of the first set.

2. The switched patch module of claim 1, wherein the motor is geared to a toothed wheel, the toothed wheel having an eccentric pin means for engagement with the panel, wherein rotation of the toothed wheel causes linear movement of the panel along the board.

3. The switched patch module of claim 2, further comprising roller means for guiding the panel in its movement along the board.

4. The switched patch module of claim 3, wherein at least one receptacle includes latch means for gripping a plug inserted into the receptacle.

5. A switched patch module, comprising:

(a) first and second sets of receptacles, mounted on a printed circuit board, both sets having at least three receptacles, (b) the printed circuit board having electrical connections which join the conductors of the first receptacle of said first set with the conductors of the first receptacle of said second set, and which similarly join the conductors of the respective second and third receptacles of the first and second sets, (c) a single slidable panel, mounted on the printed circuit board, the panel having contact means for completing electrical connections, formed on the board, (d) a tab, slidably mounted within at least the first three receptacles of said first set, the tab being slidable in the direction of the panel in response to pressure from a plug inserted into the receptacle, the panel including at least two cam surfaces positioned near the tab, wherein the tab is positioned to be urged against the cam surfaces, wherein the panel is movable in a direction generally perpendicular to the direction of motion of the tab when the tab moves towards the panel, and (e) a switch having at least two positions, the switch being operatively connected to a means for moving the panel into one of two positions, the first position completing a connection between said first receptacles and said third receptacles, the second position completing a connection between said second receptacles and said third receptacles, the panel also having a neutral position, wherein there is no connection between either of said first or second receptacles and said third receptacles, wherein the cam surfaces are configured such that, when the switch is in the first position, insertion of a plug into the first receptacle of the first set causes the panel to slide into the neutral position, and when the switch is in the second position, insertion of a plug into the second receptacle of the first set causes the panel to slide into the neutral position, and such that insertion of the plug into the third receptacle of the first set causes the panel to slide into the neutral position.

6. The switched patch module of claim 5, wherein the cam surfaces are configured such that, when the switch is in the first position, insertion of a plug into the second receptacle of the first set has no effect on the panel, and when the switch is in the second position, insertion of a plug into the first receptacle of the first set has no effect on the panel.

7. The switched patch module of claim 6, wherein the moving means comprises a motor, the motor being geared to a toothed wheel, the toothed wheel having an eccentric pin means for engagement with the panel, wherein rotation of the toothed wheel causes linear movement of the panel along the board.

8. The switched patch module of claim 7, further comprising roller means for guiding the panel in its movement along the board.

9. The switched patch module of claim 8, wherein at least one receptacle includes latch means for gripping a plug inserted into the receptacle.

10. A switched patch module, comprising: adapted to receive a plug (a) a first receptacle adapted to receive a plug, connected to a first line, (b) a second receptacle adapted to receive a plug, connected to a second line, (c) a third receptacle adapted to receive a plug, connected to a third line, (d) means for alternately connecting said first and second lines to said third line, the connecting means having a single moving element, the connecting means also comprising means for breaking all connections between said first and second lines and said third line, wherein movement of the connecting means disconnects the third line from the first and second lines, said movement caused by insertion of a plug into either of said first or second receptacles, respectively, or by insertion of a plug into said third receptacle.

11. The switched patch module of claim 10, wherein the connecting means comprises a panel, mounted for movement along a printed circuit board, the panel having electrical contacts for making and breaking electrical connections.

12. The switched patch module of claim 11, wherein the panel includes a plurality of cam surfaces, the cam surfaces being adapted for engagement with a movable member, wherein engagement of the member with the cam surface causes the panel to move along the board.

13. The switched patch module of claim 12, wherein the movable member is a tab, positioned to be moved by the plug as the plug is inserted into one of the receptacles.

14. The switched patch module of claim 13, further comprising switch means for selecting an initial position of the panel, the initial position determining which of said first and second receptacles is connected to the third line, in the absence of a plug inserted into any of said receptacles, the switch means being operatively connected to a means for moving the panel along the board.

15. The switched patch module of claim 14, wherein the moving means comprises a motor, the motor being geared to a toothed wheel, the toothed wheel having an eccentric pin means for engagement with the panel, wherein rotation of the toothed wheel causes linear movement of the panel along the board.

16. The switched patch module of claim 15, further comprising roller means for guiding the panel in its movement along the board.

17. The switched patch module of claim 16, wherein at least one receptacle includes latch means for gripping a plug inserted into the receptacle.

18. A switched patch module, comprising:

(a) a first receptacle adapted to receive a plug, connected to a first line, (b) a second receptacle adapted to receive a plug, connected to a second line, (c) a third receptacle adapted to receive a plug, connected to a third line, (d) switch means for selecting either of the first or second receptacle, (e) a switching element, controlled by the switch means, the switching element having a single moving part, the switching element connecting the receptacle selected by the switch means to the third receptacle, the switching element including means for disconnecting the selected receptacle from the third receptacle when a plug is inserted into the selected receptacle.

19. The switched patch module of claim 18, wherein the switching element also disconnects the third receptacle from the other receptacles upon insertion of a plug into the third receptacle.

20. The switched path module of claim 19, wherein the switch means is a two-position switch, and wherein the switching element is a three-position switch, and wherein the switch means and the switching element are distinct from each other.

21. A switched patch module comprising:

(a) a first receptacle adapted to receive a plug, permanently connected to a first line, (b) a second receptacle adapted to receive a plug, permanently connected to a second line, (c) a third receptacle adapted to receive a plug, permanently connected to a third line, (d) a switching element for connecting either of the first or second receptacles to the third receptacle, wherein the switching element is connected to the first and second receptacles such that insertion of a plug into either of said first and second receptacles causes the switching element to break any connection between the third receptacle and the first and second receptacles.

* * * * *